US006104301A

United States Patent [19]

Golden

[11] Patent Number: 6,104,301

[45] **Date of Patent: *Aug. 15, 2000**

[54] HAZARD DETECTION, WARNING, AND RESPONSE SYSTEM

[76] Inventor: Patrick E. Golden, 1920 18th St., #F101, Bellingham, Wash. 98225

[ * ] Notice: This patent is subject to a terminal disclaimer.

[21] Appl. No.: 09/025,972

[22] Filed: Feb. 19, 1998

Related U.S. Application Data

[63] Continuation of application No. 08/696,626, Aug. 14, 1996, Pat. No. 5,808,541, which is a continuation-in-part of application No. 08/416,318, Apr. 4, 1995, abandoned.

[51] Int. Cl.[7] ..... G08B 17/10

[52] U.S. Cl. ..... 340/628; 340/286.05; 169/60; 169/61; 169/5

[58] Field of Search ..... 340/628, 629, 340/630, 286.05; 169/60, 61, 62, 5, 26

[56] References Cited

U.S. PATENT DOCUMENTS

| | | | |
|---|---|---|---|
| 4,796,205 | 1/1989 | Ishii et al. | 364/550 |
| 5,315,292 | 5/1994 | Prior | 340/628 |
| 5,727,635 | 3/1998 | Doty et al. | 169/62 |
| 5,774,038 | 6/1998 | Welch et al. | 340/628 |
| 5,808,541 | 9/1998 | Golden | 340/630 |

*Primary Examiner*—Daniel J. Wu
*Assistant Examiner*—Anh La
*Attorney, Agent, or Firm*—Fulbright & Jaworski L.L.P.

[57] ABSTRACT

The invention provides a self-contained automatic fire detection, warning, and suppression life safety system having an extinguishant source and a fire detector coupled to an electronic processor. The processor has logic to interface with components for detecting and warning of a fire and releasing the extinguishant. Self-diagnosis logic checks the entire system's function, pressure, power level, and power source. Additional sensors are provided for detecting various hazards, and the processor has logic for proper response.

12 Claims, 6 Drawing Sheets

HAZARD DETECTION, WARNING, AND RESPONSE SYSTEM

CROSS-REFERENCE TO RELATED APPLICATIONS

This is a continuation of Ser. No. 08/696,626, Aug. 14, 1996, issued as U.S. Pat. No. 5,808,541, which is a continuation-in-part patent application of U.S. patent application Ser. No. 08/416,318, filed Apr. 4, 1995, now abandoned.

BACKGROUND OF THE INVENTION

1. Field of the Invention

The present invention relates generally to a combination fire suppression and security life safety system and more particularly to a compact, self-contained, fully automatic fire suppression device which detects ambient fire, intrusion, vapor, or various input conditions, warns of their presence, and uses its onboard control center to control various internal and external devices.

2. Description of the Related Art

Fire suppression life safety systems have evolved over many years with constraints dictated by available technology. Recent environmental banning of substances found to be toxic such as particular gases and chemical compounds have further limited safe alternatives for adequate fire protection. Modern demands for a technologically advanced, efficient, practical, and versatile life safety consumer system has, until this present invention, remained nonexistent.

When fire protection and life safety systems are reviewed one finds that people must rely on separate products for their safety. Smoke detectors, hand held extinguishers, burglar alarms and gas detectors are several examples. The combination smoke detector and audible alarm may warn of present danger for safe escape and the extinguisher is used for manual suppression of a very small spreading fire requiring the operator to be placed at considerable risk. Public safety must focus on escape, not fighting a growing flame. If the smoke detector detects the presence of smoke it has no ability to suppress the fire from spreading out of control. Additionally, if the fire extinguisher is not conveniently located with relation to the fire and the person in danger, it is rendered useless. In many cases the actual weight of the extinguisher itself prohibits the safe operation by those in need. Large area traditional sprinkler systems that use water are not always practical due to their large expense, their limitations to particular types of fires, and the great demands placed on a public water supply network that is becoming increasingly more precious if available at all. Water and smoke damage in many cases far exceed the economic impact of the fire itself. Separately installed burglar alarms and gas detectors require extensive skilled labor to install and are limited by their expense.

Many combination smoke detector/fire extinguishers have developed over time which have lacked commercial viability and relied heavily on dated technology. None of the prior art concerning automatic fire suppression life safety systems are technologically advanced in structure and function or focus on all factors of safety and practicality.

U.S. Pat. No. 5,315,292, issued to Prior, discloses a ceiling-mounted smoke detector which activates the dispensing of a chemical powder into the atmosphere. The concerns with this invention are its constraints due to the design of the housing, the dependence on dated technology, and the practical application of the extinguishant chosen.

Versatility is compromised due to the small canister's limitations in the vertical position leading to an inability to expand to meet the needs of a normal fire. One cannot place the tank horizontally to increase volume, because no provision was made for correct extinguishant positioning for expulsion. Smoke detection sensors and heat activated switches are placed within the invention, making it extremely difficult to detect a fire at its initial stages, which is the best time to respond. The use of dry chemicals or gases inherently lead to the problem of poor coverage due to tremendous drafts caused by high and low pressure variations and by oxygen-starved flames. These tremendous drafts carry light airborne particles and gases away from the area needing attention. Finally, the use of dry chemicals leaves unwanted residue on equipment and raises health concerns regarding chemical inhalation. Even with these limitations U.S. Pat. No. 5,315,292 represents an advancement in the art and so is hereby incorporated by reference in its entirety.

U.S. Pat. No. 5,123,490, issued to Jenne, discloses a self-contained, smoke-actuated fire extinguisher flooding system using a spring- loaded plunger system for the release of Halon, a trademark for bromotrifluoromethane manufactured by Ausimont U.S.A., Inc. Halon has been banned, except for limited uses, by the United States Environmental Protection Agency with no replacement designated. The design relies on old technology and lacks versatility. Several design limitations lessen the effectiveness of this invention.

U.S. Pat. No. 5,016,715, issued to Alasio, discloses an elevator- cab fire extinguisher which discharges a gas and functionally controls the elevator to arrive at a designated floor. This fire extinguisher has various limitations, and the gas has been banned. The system is not self-contained due to dependence on supplied electrical current and rechargeable batteries. A heated fuseable link and mechanical switch require a great deal of heat to activate the system, a situation which the invention was not designed to handle.

U.S. Pat. No. 4,691,783, issued to Stem et al., discloses an automatic modular fire extinguisher system for computer rooms. The concerns for this invention are its economic viability, overall dimensions, and versatility. Additionally, gas was the designed extinguishant. The above examples of prior art were designed to benefit from the properties of gases which have since been banned.

There remains a need for a portable, compact, self-contained, fully-automatic fire suppression and security life safety system which is controlled by the latest in integrated technology and incorporates the latest advances for liquid, dry chemical, and gaseous extinguishants.

SUMMARY OF THE INVENTION

The present invention provides the ability to detect and suppress a fire practically, economically, and dependably and to monitor hazards using intrusion detection, video surveillance, and gas, vapor, or various other sensors. The present invention may also control and manipulate external devices in the form of hardware or software, enhancing life safety capabilities. With obvious modifications, the present invention can protect life and property virtually anywhere and in any position.

The present invention provides a fire suppression and security life safety system for transportation, residential, or commercial applications. This system is automatically controlled by microprocessor-based circuitry and devices for remote and manual activation. The fire suppression system is self-contained, uses various forms of extinguishant, and detects and warns of heat or smoke buildup. Using onboard sensors, it detects and warns of intrusion or gas presence and manipulates external devices using inputs and outputs directed to the control device independently or as a series of units. The present invention eliminates the above described disadvantages of the prior art.

In one embodiment the present invention provides a hazard detection, warning, and response (or control) system. The system includes a sensor for detecting a hazard, a processor coupled to the sensor, a warning device coupled to the processor, and a response device coupled to the processor for responding to the hazard, wherein the processor has logic for monitoring the sensor and activating the warning device and the response device.

In one aspect the present invention provides an automatic fire detection and suppression system. This system includes a fire extinguishant, a pressure vessel for containing the fire extinguishant under pressure, a discharge nozzle, tubing providing fluid communication between the fire extinguishant and the discharge nozzle, a normally closed solenoid valve coupled to the tubing for holding the fire extinguishant under pressure and for releasing the fire extinguishant, a processor coupled to the valve, a fire sensor coupled to the processor for detecting a fire, and an audible and/or a visual alarm (horn, siren, buzzer, light, and/or beacon) coupled to the microprocessor. The processor includes logic for running a diagnostic test and logic for monitoring the fire sensor, opening the valve for a period of time if the fire sensor indicates a fire is detected to suppress the fire, and activating the alarm.

In a preferred embodiment the system includes a hazard sensor coupled to the circuit board, a hazard-related output from the processor, and logic in the processor for monitoring the hazard sensor and initiating the hazard-related output. The hazard sensor can be a gas detector, a intrusion detector, or a video camera. Preferably, the system includes a remote activation apparatus for manually opening the valve from a remote location. The remote activation apparatus includes a signal transmitter for sending a signal, an activation device coupled to the signal transmitter for activating the signal transmitter, a signal receiver coupled to the processor for receiving the signal from the signal transmitter, and logic in the processor for detecting the signal and opening the valve when the signal is detected. The signal may be an ultrasonic, radio, infrared, or laser signal.

BRIEF DESCRIPTION OF THE DRAWINGS

A better understanding of the present invention can be obtained when the following detailed description of the preferred embodiment is considered in conjunction with drawings described as follows.

DETAILED DESCRIPTION OF INVENTION

Figure 1:
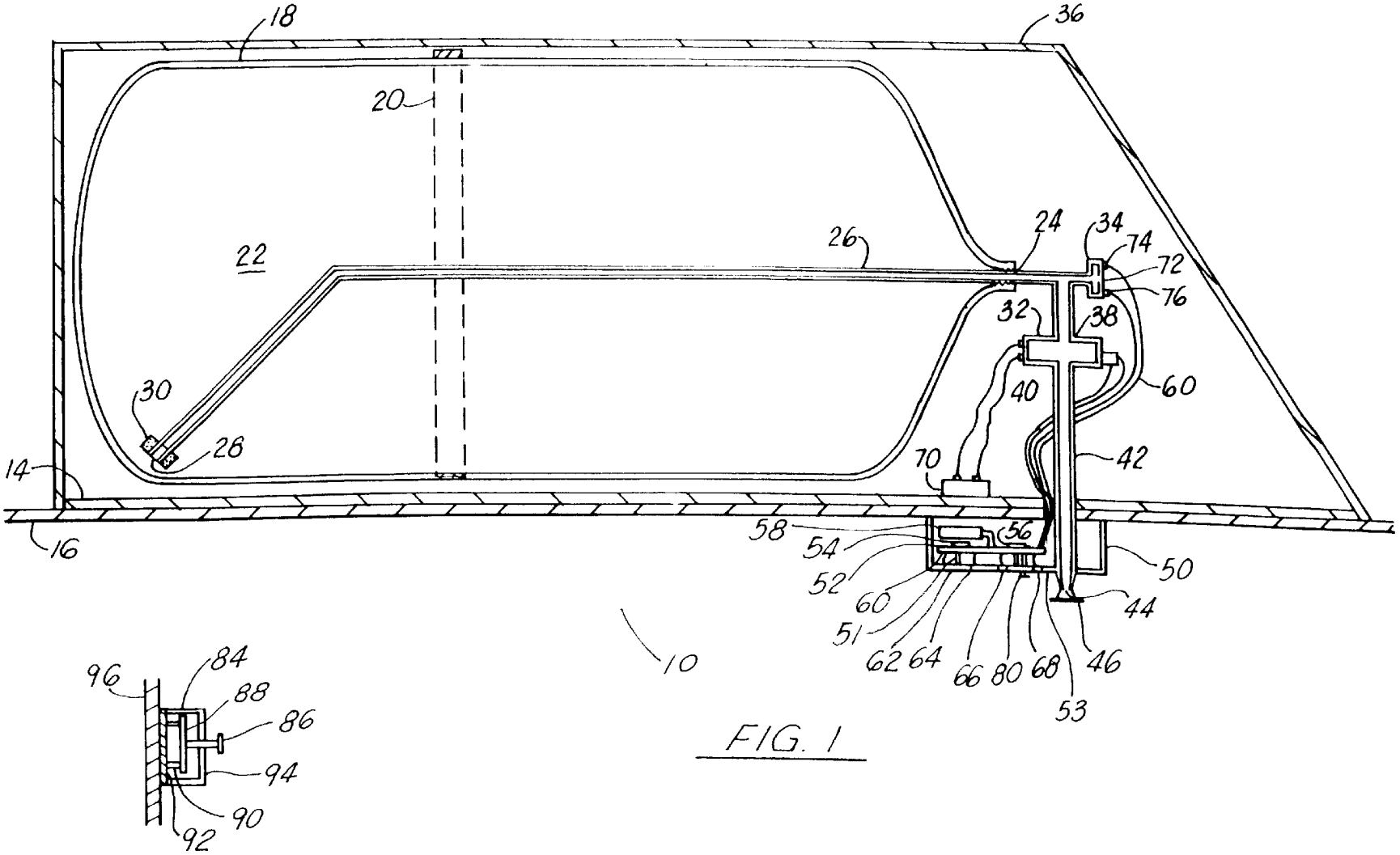
FIG. 1 is a longitudinal cross section of a hazard detection, warning, and control system, according to the present invention.
Figure 2:
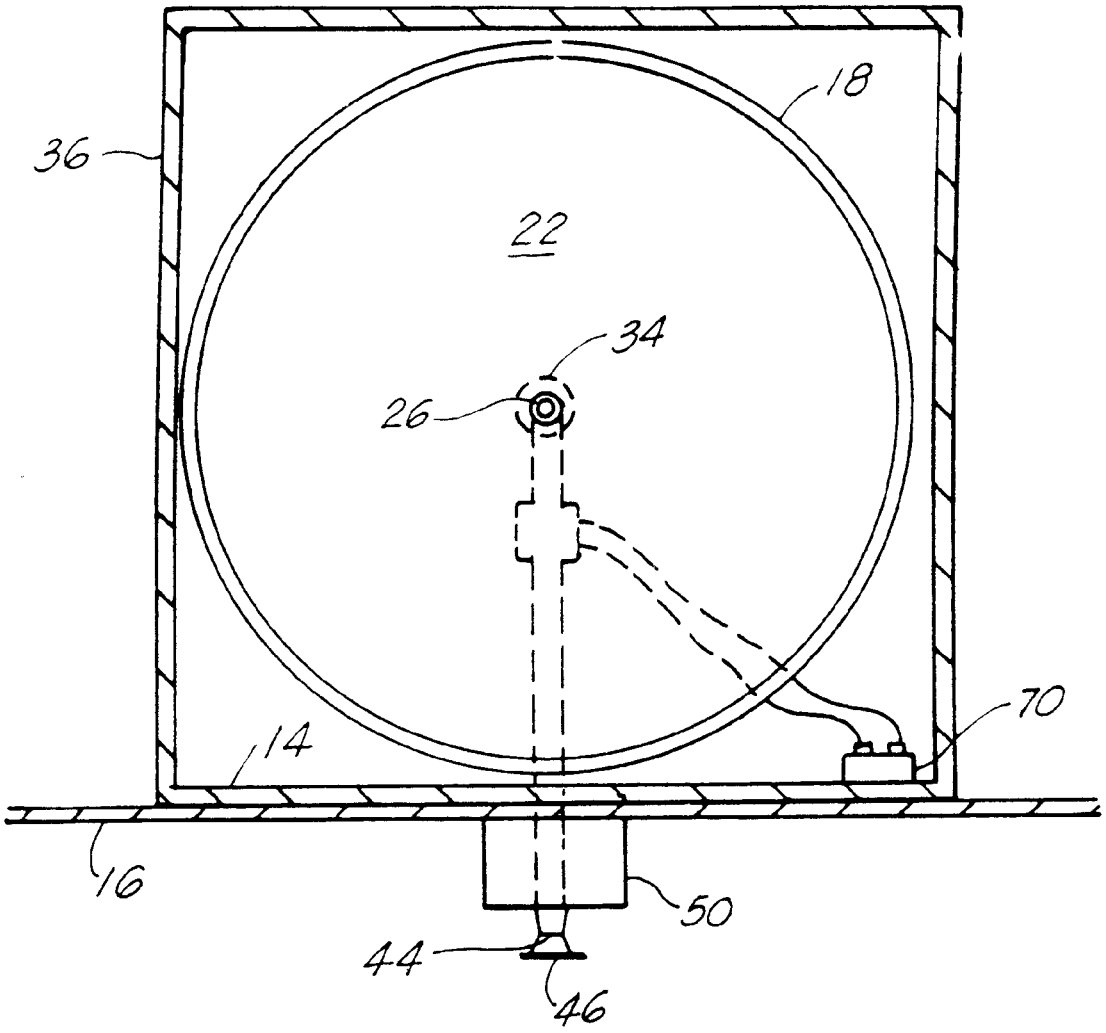
FIG. 2 is a transverse cross section of the hazard detection, warning, and control system of FIG. 1.

With reference to FIGS. 1 and 2, a hazard detection, warning, and response system 10 is shown, according to the present invention. A base 14 is secured to a mounting surface 16. In this embodiment base 14 is mounted above mounting surface 16, however, base 14 can be suspended from mounting surface 16.

A pressure vessel 18 is secured to base 14 by a support strap 20. Pressure vessel 18 contains a fire extinguishant 22 under pressure, preferably at a pressure of about 200 pounds per square inch. Fire extinguishant 22 may be a liquid, dry chemical, or gaseous extinguishant. Pressure vessel 18 is shown in a horizontal position, but other configurations can be used. Pressure vessel 18 has a single, threaded opening 24. In this preferred embodiment pressure vessel 18 is approximately a five-gallon container, holding four gallons of extinguishant. Pressure vessel 18 can be sized to meet the requirements for a particular application and is manufactured from any suitable material including, but not limited to, aluminum, steel, or a filament-wound composite material.

A dip tube assembly 26 is threaded into the pressure vessel 18. Dip tube assembly 26 preferably has a forty-five degree bend, placing an opening 28 near a lowermost point of pressure vessel 18 in either a horizontal or a vertical installation of pressure vessel 18. Dip tube assembly 26 allows flexibility in installing the system 10 because pressure vessel 18 can be installed vertically, with opening 28 at a low point, or horizontally, again with opening 28 at a low point. A strainer 30 is placed about opening 28 to prevent the intake of particulate matter. Dip tube assembly 26 has male threads that engage female threads in pressure vessel opening 24. An O-ring (not shown) provides a tight, leak-resistant seal where dip tube assembly 26 connects to opening 24. The O ring is a flexible material, such as rubber, suitable for use in high-pressure applications. A seat (not shown) is provided for the O ring.

A solenoid valve 32 is normally closed, holding the extinguishant 22 under pressure. A pressure gauge 34 is in fluid communication with extinguishant 22, providing a pressure indication. A housing 36 provides an enclosure around the pressure vessel 18. Solenoid valve 32 is preferably a two-port, normally closed, direct current (DC) solenoid valve. Solenoid valve 32 is a conventional solenoid valve, and consequently, its details, such as its electrical motor, are not shown. Solenoid valve 32 has an inlet port 38 and an outlet port 40. A nozzle assembly 42 connects to solenoid valve outlet port 40. Nozzle assembly 42 has a nozzle outlet 44, and a deflector 46 is attached to nozzle outlet 44.

A control housing 50 is mounted to mounting surface 16 and houses a circuit board 52. Control housing 50 is made from molded composite material and is preferably oval in shape and approximately six inches long, three inches wide, and two inches deep. A circuit board foundation 51 is molded integral to the interior of control housing 50. Circuit board foundation 51 is a set of offsets or stands for receiving and securing circuit board 52. Circuit board 52 is fastened to circuit board foundation 51 by screws, clips, or snaps. Control housing 50 has an opening for receiving nozzle assembly 42. Control housing 50 is bored with a set of holes or vents for monitoring ambient conditions. Control housing 50 has a ventral side 53 distal from mounting surface 16. Ventral side 53 has a series of openings for indicators and sensors described below.

Circuit board 52 is a motherboard and receives orphan boards 54. A microprocessor 56 is coupled with circuit board 52 to provide logic for detection, warning, and control using numerous inputs and outputs, as described below. In this preferred embodiment microprocessor 56 is a conventional device with several inputs and outputs and of the read only memory (ROM) variety. A battery 58, preferably a 9-volt lithium-based battery, provides power for circuit board 52. Alternatively, battery 58 is a power supply that can be replaced by alternating line current converted to direct current through an external input connection. Numerous electrical conductors 60 provide electrical connection with various inputs and outputs. A heat and/or smoke detector 62 is coupled to circuit board 52 and is either a conventional thermistor or a combination heat sensor and ionic smoke sensor. An audible alarm 64, a dual decibel high pitch siren or buzzer, is provided for an audible warning in the event of a hazardous situation having been detected. A visual alarm 66, such as a lamp or beacon, is provided as a visible warning that a hazard has been detected by one of the sensors. A voice alarm can be added to communicate instructions. Additional sensor ports 68 can be coupled to circuit board 52 to include, for example, a gas detector, a video camera, and/or a location and position sensor coupled to a satellite system, a global positioning system. Various light emitting diodes are provided for visually indicating status, including for example, power level, power source, pressure, and total system function.

If a hazard is detected by heat detector 62 or sensor 68, a signal can be sent to open solenoid valve 32 allowing the extinguishant 22 to escape under pressure through nozzle outlet 44. For example, when a fire occurs in the vicinity of heat detector 62, an abnormally high temperature will be detected and a signal will be sent through electrical conductors 60 to open solenoid valve 32 (after a ten-second delay). Since the extinguishant 22 is stored in pressure vessel 18 under high pressure, the extinguishant 22 discharges through nozzle outlet 44 when solenoid valve 32 opens. Solenoid valve 32 remains open long enough to release a major portion of extinguishant 22, but not all of it. Solenoid valve 32 resets and is ready to work again with the remaining extinguishant.

A power supply 70 is provided for opening solenoid valve 32. Power supply 70 is a high performance battery, such as a lithium-based battery, for self-contained operation. Power supply 70 is comprised of either six or twelve volt cells, but rechargeable cells may be used. Power supply 70 is preferably of a higher voltage and current rating than battery 58. Power supply 70 provides a high energy source directly to solenoid 32 so that the circuitry of circuit board 52 does not have to withstand the high current required for solenoid valve 32. Alternatively, power supply 70 can be replaced by alternating line current converted to direct current through an external input connection.

A pressure gauge monitor 72 attaches to pressure gauge 34 and is made from a set of light-emitting and receiving diodes 74 and 76. In this preferred embodiment pressure gauge 34 has an indicator pointer which is not shown. Conventional diodes 74 and 76 are placed in an opposing position facing each other with the indicator pointer between diodes 74 and 76. Movement of the indicator pointer on pressure gauge 34 is detected by diodes 74 and 76, and a signal is sent to microprocessor 56 indicating a drop or rise in pressure in pressure vessel 18. Normally, the solenoid valve 32 will be closed and the pressure indicated by gauge 34 will remain essentially constant. In this case the indicator pointer will stay in a relatively fixed position. However, if the solenoid valve 32 is opened, then a sudden drop in the pressure of extinguishant 22 will be indicated by gauge 34, and consequently, there will be a movement of its indicator pointer. Diodes 74 and 76 detect this movement of the indicator pointer and send an output signal to microprocessor 56. Logic in microprocessor 56 activates audible alarm 64 and visual alarm 66 through circuit board 52.

Normally, solenoid valve 32 remains in a closed position. However, if a hazard such as a fire is detected by one of the sensors such as heat detector 62, then a signal is sent via electrical conductor 60 to open solenoid valve 32. A push-button switch 80 is also provided for activating the system. Push-button switch 80 allows an operator to press switch 80 to open solenoid valve 32, activating the system to release extinguishant 22.

Alternatively, a remote transmitter 84 can be used to activate the system and/or open solenoid valve 32. Opening of solenoid valve 32 is not the only output possible from microprocessor 56. Various inputs and outputs are available and can be used to manipulate any of several peripheral devices. An output signal can be sent to open or close doors, to inactivate elevators, communicate with a remote control system, or to communicate with any other type of peripheral device or media Inputs and outputs will allow several units to be interfaced and monitored by a central control unit.

Remote transmitter 84 is typically located within 30 feet of control housing 50 when using ultrasonic communication. Remote transmitter 84 allows an operator to activate a particular aspect of the microprocessor 56 or circuit board 52 while remote from the hazard detected by one of the sensors such as heat detector 62 which detects heat produced by a fire. Remote transmitter 84 has a push-button switch 86 connected to a circuit board 88. Circuit board 88 is mounted by stand-offs 90 to a base 92. A remote transmitter housing 94 encloses circuit board 88. Base 92 is mounted to a support structure 96. Communication between remote transmitter 84 and circuit board 52 preferably uses an ultrasonic wave signal, but infrared, radio, and laser signals, as well as direct wiring can be used.

Figure 3:
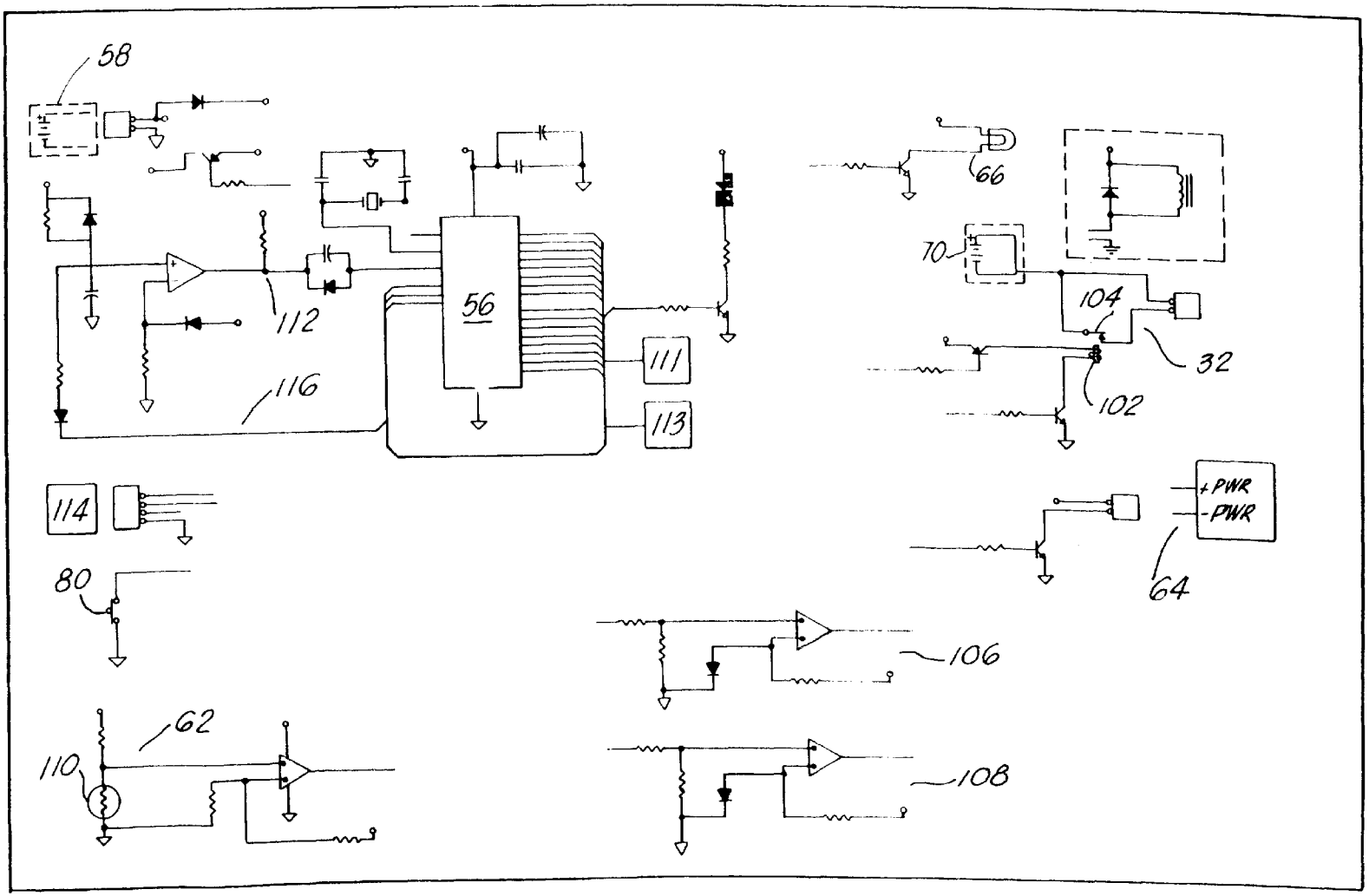
FIG. 3 is a schematic of circuitry and a processor used in the hazard detection, warning, and control system of FIG. 1.

Turning now to FIG. 3, a schematic diagram for some of the circuitry associated with circuit board 52 is shown. Microprocessor 56 can have as many inputs and outputs as are needed for a particular application. The inputs would include measurements from various sensors and outputs would include outputs to peripheral devices and to solenoid valve 32. A low voltage signal is sent to solenoid valve 32 where a relay 102 activates a switch 104 providing a high energy source from power supply 70 to solenoid valve 32. Relay 102 is of a reed or similar type rated to handle the proper current needs. Battery 58, or an equivalent power supply, provides power to circuit board 52 and microprocessor 56 as well as other circuits contained on the circuit board 52.

Alternating current (AC) converters (not shown) can be used to provide DC power as a substitute for battery 58 or for DC power supply 70. Electronic circuit 106 couples battery (or power supply) 58 to microprocessor 56, and electronic circuit 108 couples power supply 70 to microprocessor 56. Heat detector 62 is preferably a thermistor 110. Thermistor 110 has parameters that can be set so that when a first temperature is detected the timing for further checks of the temperature can be shortened in its interval until further temperature rises reach an upper temperature limit which would then activate an input for microprocessor 56. Push-button switch 80 can be used for manual activation or a manual input to microprocessor 56. Depending on the input that microprocessor 56 receives, microprocessor 56 can be programmed to provide a particular output. A reset circuit 112 provides a reset function for microprocessor 56. This allows microprocessor 56 to run various functions and diagnostics and return to a starting condition ready to open solenoid valve 32 again to release additional extinguishant 22.

A clock chip 111 is coupled to microprocessor 56 to provide a timing mechanism, and a recordation device 113 is coupled to clock chip 111 for recording time and temperature measurements. Circuit board 52 has an ultrasonic receiver board 114 for receiving ultrasonic transmissions from remote transmitter 84. An ultrasonic circuit 116 couples ultrasonic receiver board 114 and microprocessor 56.

Figure 4:
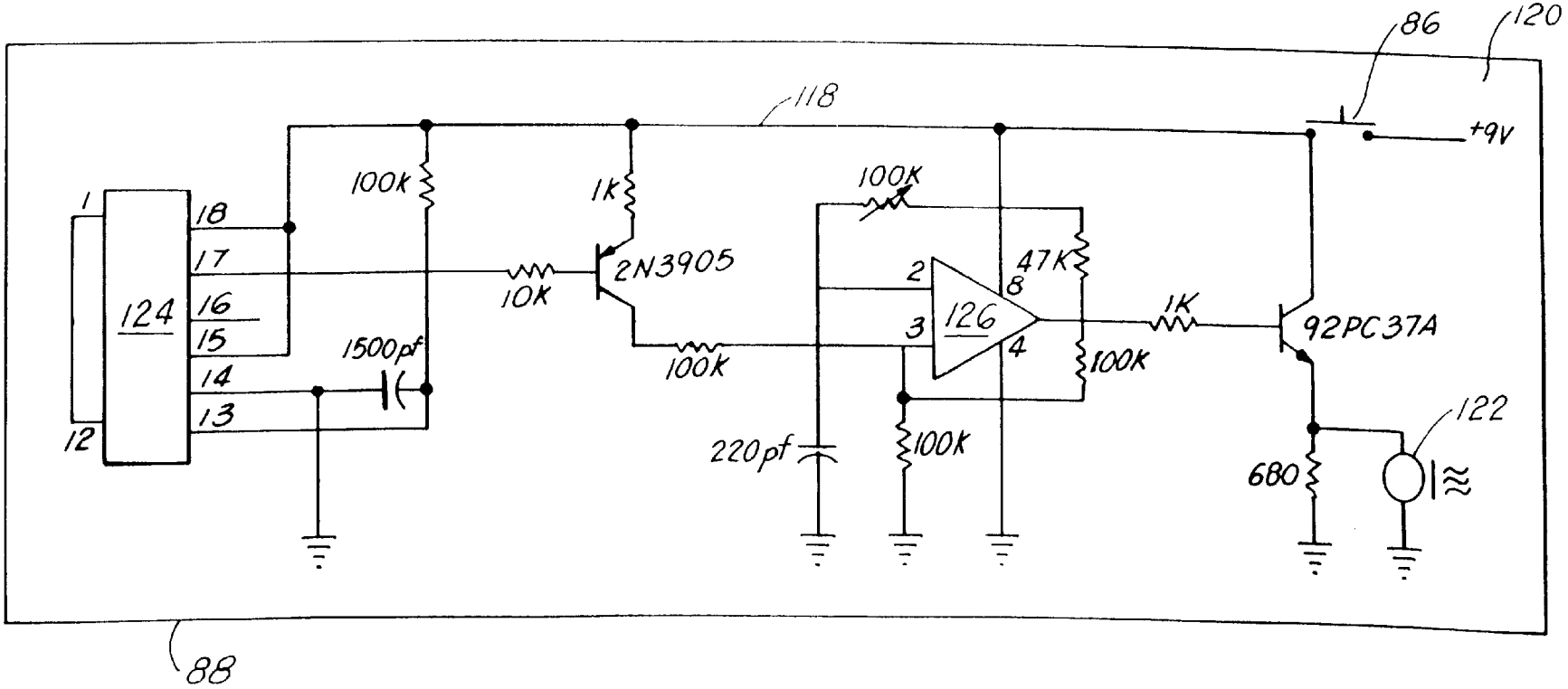
FIG. 4 is a schematic of circuitry used to send a signal from a remote transmitter for remote activation of the hazard detection, warning, and control system of FIG. 1.
Figure 5:
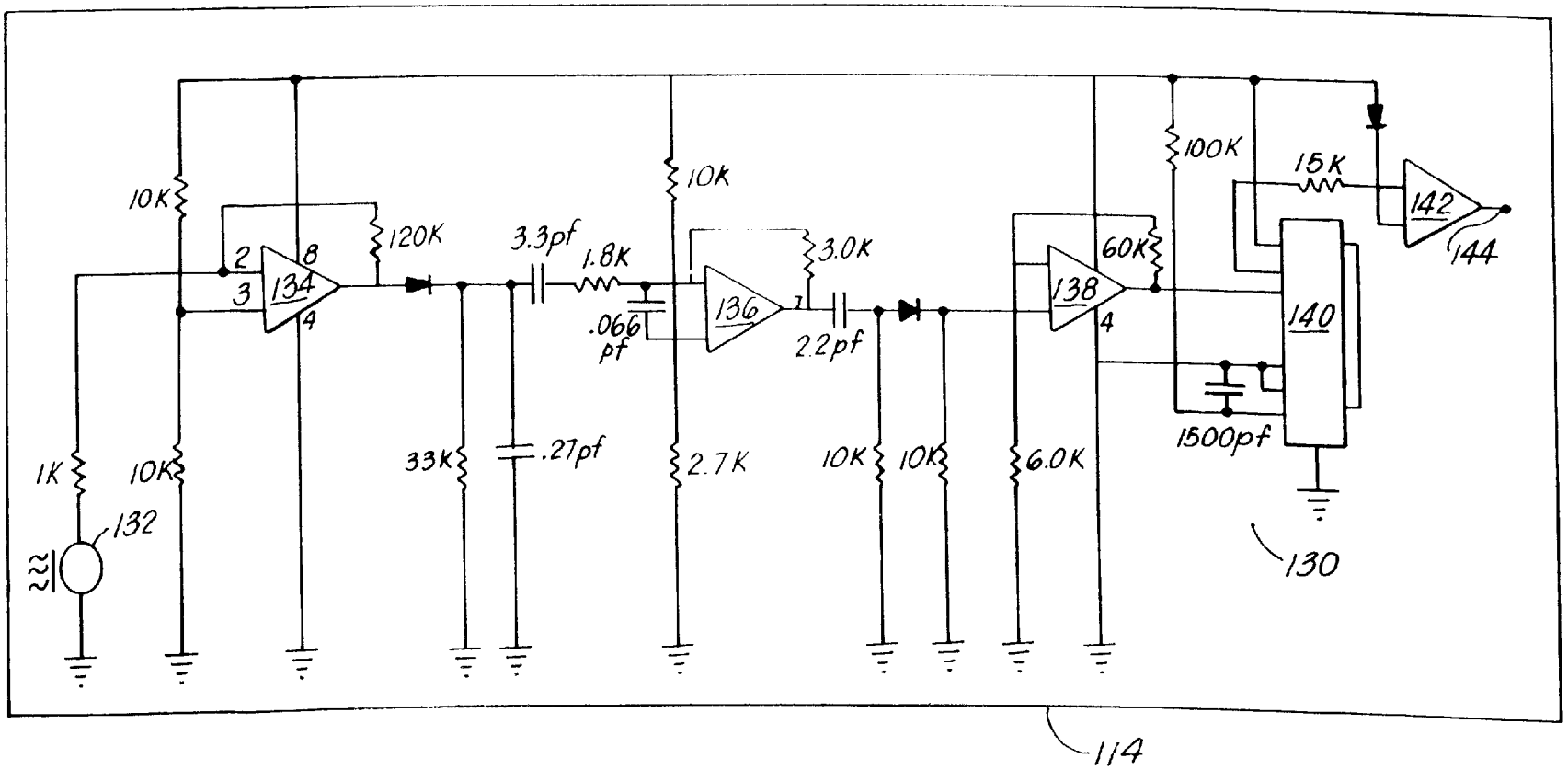
FIG. 5 is a schematic of circuitry used to receive the signal from the remote transmitter of FIG. 4.

Turning now to FIGS. 4 and 5, schematic diagrams are provided illustrating the circuitry for transmitting and receiving ultrasonic signals for remote operation of the microprocessor 56. With reference to FIG. 4, circuit board 88 is shown for transmitting a remote ultrasonic signal to microprocessor 56. An ultrasonic transmitter schematic diagram illustrates circuitry 118 for transmission of an ultrasonic signal from remote transmitter 84 to microprocessor 56.

Remote transmitter 84 is activated by depressing push-button switch 86 completing a circuit. A DC power supply 120 provides electrical current to the circuit when push-button switch 86 is depressed. Transmitter circuitry 118 contains a wave transducer 122, a wave encoder/decoder chip 124, and a full operational amplifier 126 powered by power module 120, which is rated at 9 volts. Power module 120 preferably houses a 9-volt lithium battery having sufficient current to power transmitter circuitry 118. When push-button switch 86 is depressed completing the circuit between power module 120 and wave encoder/decoder 124, a signal is transmitted and amplified by operational amplifier 126, and that signal is transmitted as an ultrasonic signal produced by wave transducer 122. Thus, wave transducer 122 ultimately sends out an ultrasonic signal from remote transmitter 84 to microprocessor 56. The ultrasonic signal sent out by wave transducer 122 is received by ultrasonic receiver board 114 on circuit board 52.

Turning now to FIG. 5, a schematic diagram is shown for receiver circuitry 130 on ultrasonic receiver board 114. A wave receiver transducer 132 receives the ultrasonic signal from wave transducer 122 of remote transmitter 84. The signal from wave receiver transducer 132 is amplified by dual operational amplifiers 134, 136, and 138. A wave receiver encoder/decoder chip 140 receives the ultrasonic signal and transmits it to operational amplifier 142. Operational amplifier 142 has an output 144 for connection with ultrasonic input circuit 116 on circuit board 52 as shown in FIG. 3. Wave encoder/decoder chip 124 and wave receiver encoder/decoder chip 140 are conventional chips capable of both transmitting and receiving ultrasonic, infrared, and radio signals.

Thus, a remote signal can be sent to microprocessor 56 by remote transmitter 84. An operator may detect a hazard and depress push-button switch 86 sending an ultrasonic signal via wave transducer 122 (FIG. 4) from the transmitter board 88. Ultrasonic receiver board 114 receives the signal from wave transducer 122 via wave receiver transducer 132 (FIG. 5). Receiver circuitry 130 amplifies and decodes the signal to provide an output at point 144 which is in connection with ultrasonic input circuit 116 (FIG. 3). As shown in FIG. 3, ultrasonic input circuit 116 provides input to microprocessor 56 from receiver board 114. Microprocessor 56 can be programmed to analyze various inputs and provide various outputs both to devices within the hazard monitoring, warning, and control system 10 and to external peripheral devices (not shown).

Figure 6:
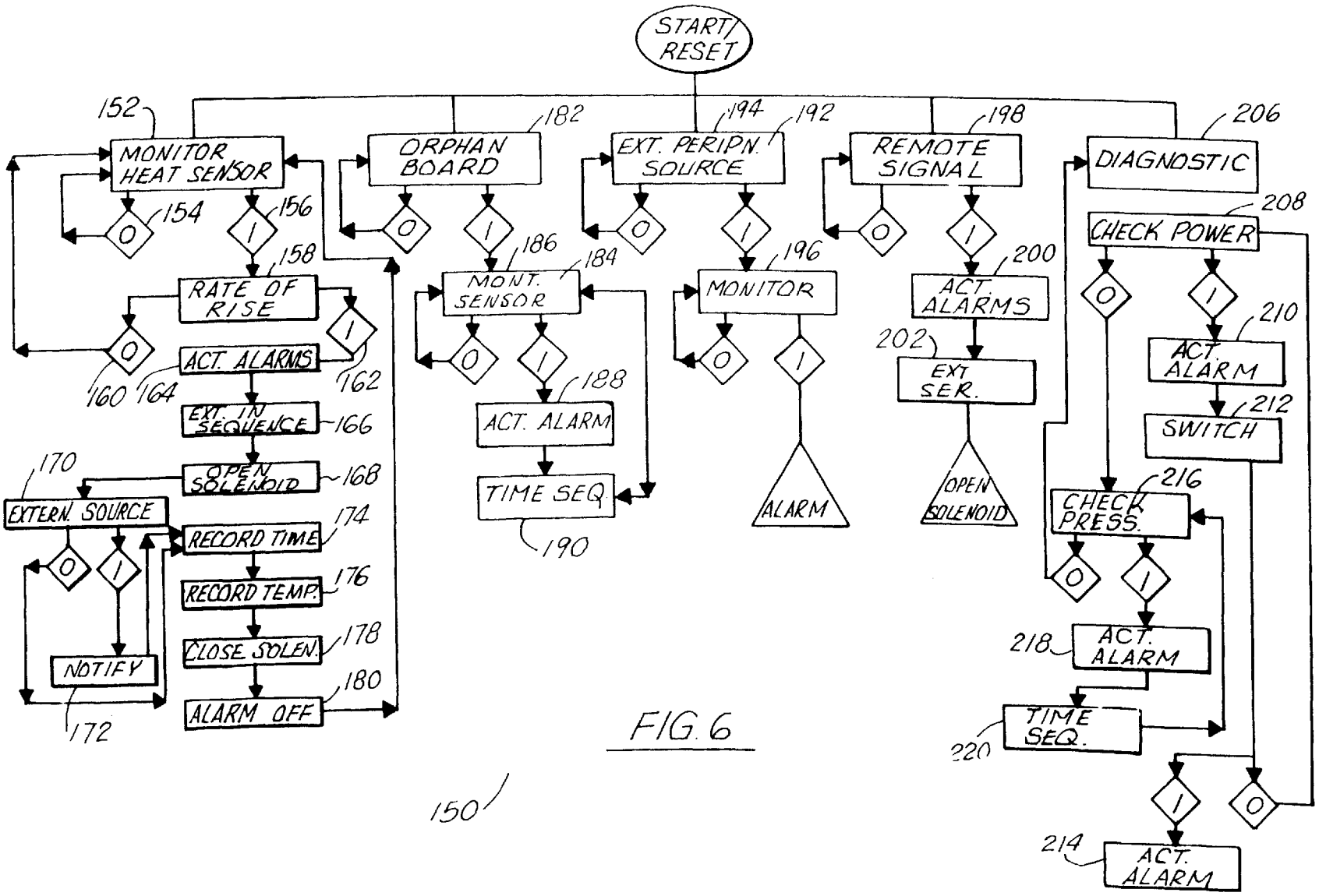
FIG. 6 is a flow chart for the hazard detection, warning, and control system of FIG. 1.

Turning now to FIG. 6, a flow chart 150 illustrates a preferred embodiment for the logic of microprocessor 56. As shown in FIG. 3, reset circuit 112 provides a start or reset for microprocessor 56. With reference to FIG. 6, microprocessor 56 has numerous steps that it executes. In step 152, microprocessor 56 monitors heat sensor 62. If heat sensor 62 is below a minimum temperature, then no action is taken as indicated by "0" 154. If, however, heat sensor 62 is above a minimum temperature, then, as indicated by "1" 156, then a rate of rise step 158 is activated. The rate of rise step 158 provides a maximum temperature for heat sensor 62. If the temperature indicated by heat sensor 62 is below a maximum value, then no action is taken as indicated by the "0" 160, and the step 152 is repeated. If the temperature indicated by sensor 62 is equal to or above a maximum predetermined value, then action is taken as indicated by "1" 162. This action can include activating an alarm by step 164 which would then lead to activation of the extingusher sequence as indicated by step 166. In step 166, the extinguisher sequence will open solenoid valve 32 per step 168.

An external source step 170 allows notification of an operator at a remote location via the notify step 172. A time recordation step 174 records the current time in recordation device 113, and at the same time a temperature recordation step 176 records the current temperature in recordation device 113. After the temperature recordation step 176, microprocessor 56 moves into a close solenoid step 178, where it sits in a holding pattern for a predetermined period of time, allowing a major portion of extinguishant 22 to be discharged from pressure vessel 18 through nozzle outlet 44 (FIG. 1). After extinguishant 22 has been discharged, microprocessor 56 turns audible alarm 64 off in the alarm-off step 180. Having gone through this sequence, microprocessor 56 returns to step 152 to repeat the sequence with the remaining extinguishant 22. However, when extinguishant 22 has been fully discharged, pressure vessel 18 must be refilled and manually reset.

Microprocessor 56 monitors orphan board 54 which may include an intrusion detector (sensing motion, glass breakage, or circuit disruption by wired or wireless means), a gas sensor and gas sensor board, and/or other sensors. The status of sensors connected to orphan board 54 are monitored in orphan board step 182. In this illustration, a motion sensor 184 and a motion sensor step 186 is included. Thus, any motion within sight of the motion detector 184 will cause activation of audible alarm 64 in alarm activation step 188. A time sequence step 190 turns alarm 64 off after a predetermined period of time. Alarm activation step 188 and time sequence step 190 can cause microprocessor 56 to output a signal to a remote location.

An external peripheral source 192 can be monitored by external peripheral source step 194. If an external peripheral source is detected as an activation signal in monitor step 196, then alarm 64 can be activated.

In remote signal step 198, microprocessor 56 can monitor for a signal from remote transmitter 84. If a signal is detected, then alarm 64 can be activated with alarm activation step 200. If alarm activation step 200 is initiated, then extinguisher sequence 202 is activated opening solenoid valve 32 and discharging extinguishant 22 through nozzle outlet 44.

Microprocessor 56 runs a diagnostic test using diagnostic step 206. It checks battery power in a check power step 208, and if power is detected as low then alarm activation step 210 sounds alarm 64 and switches to an alternative source of power using source switching step 212. If the alternative source of power meets parameters set in the diagnostic test, then a return is made to the check power step 208, but if the alternative power source is inadequate, then an alarm is activated by step 214.

If check-power step 208 finds adequate power, then the diagnostic moves to check pressure step 216. This step uses the input from diodes 74 and 76 (FIG. 1) of pressure monitoring system 72 to input a signal indicating whether there has been an abnormal change in pressure. If no abnormal change in pressure is detected, then the diagnostic returns to diagnostic step 206 and repeats the sequence. However, if an abnormal pressure change is detected in step 216, then alarm 64 is activated by alarm activation step 218. A time sequence step 220 provides a period of time in which the alarm is activated, after which the alarm 64 is deactivated and the sequence is returned to step 216. Since a number of the steps are time dependent, microprocessor 56 necessarily has a clock or means for timing its operations.

With microprocessor 56 being programmable, the possibilities for its logic are nearly endless. Numerous inputs can be monitored and numerous output signals can be delivered both to internal and external devices. In this preferred embodiment, microprocessor 56 is a read-only memory device, but can include random access memory, storage memory, and supporting electronic circuitry. Microprocessor 56 can be a programmable logic controller, a complex instruction set computer, a reduced instruction set computer, or any other type of suitable processor for the application anticipated.

Operation of this advanced fire suppression life safety system or hazard detection, warning, and response system 10 has a preferred embodiment encompassing two basic principles of operation which are 1) an automatic fire suppression and control system or 2) as a suppression control system functioning by remote or manual activation. The present invention responds under both principles simultaneously. As an automatic system, the present invention operates without physical activation from any outside operator. However, the system can be activated manually by either push-button switch 80 or by remote transmitter 84 (FIG. 1).

Electrical current to all respective system components is provided from either battery (or power supply) 58 or power supply 70 for solenoid valve 32. If microprocessor 56 ever inputs a less than minimum voltage level from battery 58 or power supply 70, it will provide a power level and source indication (not shown) and switch to power supplied by an AC converter, if provided. Conversely, if microprocessor 56 is being powered by an AC converter that becomes nonfunctional, microprocessor 56 will switch battery (or power supply) 58 to its battery source.

Upon sensing heat or smoke, heat detector 62 (or a suitable sensor) inputs an abnormality to microprocessor 56 which calculates the rate and intensity rise of such heat compared to an ionic smoke density formula. If formula calculations confirm an abnormal condition is present, microprocessor 56 outputs electronically to several locations. Microprocessor 56 sends the proper electronic signals through a relay to visual alarm 66, audible alarm 64, a time indicator, and to any appropriate external output device via an output connection. An electrical impulse is communicated approximately ten seconds later via wires 60. At any time during those ten seconds, activation of remote transmitter 84 or of manual push-button switch 80 disarms the system 10, allowing deactivation of a false alarm. If the system 10 is not deactivated, then solenoid valve 32 opens six to ten milliseconds later drawing 0.65 to 9.0 watts of power from power supply 70. Audible alarm 64 and visual alarm 66 will continue to operate for several minutes.

When solenoid valve 32 opens, pressurized extinguishant 22 discharges through dip tube assembly 26, nozzle assembly 42, and out through nozzle outlet 44, suppressing the fire that was detected by heat detector 62. Solenoid valve 32 may have a latching mechanism that allows the valve to remain open until it is serviced and/or replaced. Pressure vessel 18 can be refilled by attaching to nozzle outlet 44 a supply line for extinguishant 22 from an external source. Solenoid valve 32 can be manually opened by depressing push-button switch 80 and pressurizing an external source of extinguishant 22 into pressure vessel 18. Of course, other configurations and valving arrangements can be used for refilling pressure vessel 18 with extinguishant 22.

Several external output device connections are included to control external functions such as automatic communication to a rescue or emergency agency through wired or wireless means, an external ventilation or blower device, or to a relay switch which disconnects power supplying the property in danger. An external input device connection will receive signals from sources such as other units in series, an ignition switch as would be in a marine craft, or an external communication device.

When system 10 is used manually, activation of control circuit board 52 is enabled by the depression of switch 80 which makes electronic connection directly to microprocessor 56. After the activation process is initiated, the functional sequence is identical to the automatic process above. For remote control, an operator depresses remote power switch 86 and activates circuit 118 sending a signal from wave transducer 122 (FIG. 4). Ultrasonic wave transducer 122 operates at a frequency of between thirty and sixty kilohertz depending on transmission distance desired. The clock of encoder chip 124 is set to 12.5 kilohertz with pulses of 3.2 milliseconds.

Pressure gauge 34 is rated to function in a range suitable for pressure vessel 18, typically including two hundred pounds per square inch (FIG. 1). Another type of pressure transducer may be substituted for pressure monitoring. Pressure gauge monitor 72 operates by sending a beam between light emitting and receiving diodes 74 and 76. If the pointer of pressure gauge 34 ever moves below a certain point indicating a drop of pressure in pressure vessel 18, the beam will be broken on diodes 74 and 76. This event is transmitted to microprocessor 56, which will then illuminate a pressure level sensor indicator and sound audible alarm 64 at a different decibel and sequence than in the event of a fire detection.

Orphan board 54, located on control circuit board 52, is designed to interface with multiple hardware inputs such as an intrusion detector board, gas sensor board, or video board. These devices plug in to become part of circuit board 52 and are instantly recognized by microprocessor 56. The motion detector board operates by ultrasonic waves produced by ultrasonic wave transducer 122, but laser or infrared means can be used. A conventional gas sensor can be incorporated to detect carbon monoxide, methane, propane, benzene, or other gases, but a heater driver circuit may be needed for stability. Audio and video boards can enhance communication capabilities through any media such as a satellite dish or wireless.

An alternative embodiment of the present invention is smaller and fits in the engine compartment of a marine craft.

The craft's ignition mechanism is wired through the external input device connection. The external output device connection feeds into a ventilation control mechanism for the engine compartment. As an operator of the marine craft turns on the ignition, microprocessor 56 checks for volatile gases in the engine compartment using sensor 68. If a dangerous level of gas is found present, microprocessor 56 directs the ventilation device to engage before allowing the ignition system on the craft to operate. This exhausts the gas from the engine compartment thereby eliminating an explosion. Alternatively, the engine can be prevented from starting until the volatile gas is no longer detected, allowing for manual ventilation of the engine compartment.

System 10 can be used in many applications. System 10 can be used in residential rooms, offices, computer rooms, railroad cars for both passengers and cargo, aircraft and ship cargo holds, and industrial buildings. System 10 can be customized for particular applications, such as by the type of sensors or extinguishant.

Technology such as wireless communication, voice activation and recognition, compact discs, human feature comparison, satellite ground positioning satellite surveillance, advanced media communication and semiconductor crystal advancements can be incorporated into the present invention. An independent compressed gas source can be included to create a foam device. A strain gauge can be added to monitor the weight of extinguishant 22 or an interface level detector can be added to determine the amount of extinguishant 22 in pressure vessel 18. Sensors can be added to detect explosives. A central control unit can interface with multiple hazard detection, warning, and response systems 10 and with external devices for monitoring and control. Connection can be through a cable system, telephone system, or by microwave or wireless means. An alternative source of extinguishant, such as water, can be incorporated. Selenium cell power or solar energy can be used as a power supply for recharging batteries. A nozzle adjustable for a particular spray pattern, such as a rectangle of a particular size, can be substituted for discharge nozzle 44.

Obviously, modifications and alterations to the embodiment disclosed herein will be apparent to those skilled in the art in view of this disclosure. However, it is intended that all such variations and modifications fall within the spirit and scope of this invention as claimed.

I claim:

1. An automatic fire detection and suppression system, comprising:

a vessel for containing a fire extinguishant under pressure;

a dip tube assembly sealingly engaged within an opening of the vessel, the assembly including a dip tube with one end extending inside the vessel and the other end being external to the vessel;

a solenoid valve having an inlet and an outlet, the inlet being connected to the other end of the dip tube, the valve being normally closed;

a nozzle assembly connected to the outlet, the nozzle assembly including a discharge nozzle for discharging extinguishant;

a circuit board coupled to the solenoid valve;

a housing for receiving the circuit board;

a microprocessor received on and coupled with the circuit board; and a heat sensor and an ionic smoke sensor coupled to the microprocessor for sensing heat and/or smoke, wherein the microprocessor has logic for detecting heat or smoke, logic for calculating a rate of rise or for comparing to an ionic smoke density formula for determining the presence of a fire, and logic for opening the solenoid valve when the presence of a fire is determined so that the extinguishant is released to suppress the fire.

2. The automatic fire detection and suppression system of claim 1, wherein the dip tube extending inside the vessel includes a bend for placing one end of the dip tube at a low point in the vessel so that the extinguishant enters the dip tube when the vessel is installed in either a horizontal or a vertical position.

3. The automatic fire detection and suppression system of claim 1, wherein the microprocessor has logic for releasing a major portion of a full load of extinguishant and logic for resetting so that the remaining portion of extinguishant can be released.

4. The automatic fire detection and suppression system of claim 1, further comprising a recordation device for recording time and temperature.

5. The automatic fire detection and suppression system of claim 1, further comprising:

a first power supply coupled to the solenoid valve for opening the valve; and a second power supply coupled to the circuit board for providing power to the circuit board, the first power supply providing a higher current than the second power supply, the first power supply providing current directly to the solenoid valve so that the circuit board does not encounter the higher current of the first power supply.

6. The automatic fire detection and suppression system of claim 1, further comprising a remote wireless transmitter located remote to the circuit board and a receiver coupled with the circuit board, wherein the transmitter can be used to open the solenoid valve.

7. The automatic fire detection and suppression system of claim 6, wherein the transmitter includes an ultrasonic wave transducer operating at a frequency between thirty and sixty kilohertz.

8. The automatic fire detection and suppression system of claim 1, wherein the microprocessor has logic for running a diagnostic test for checking pressure in the vessel.

9. The automatic fire detection and suppression system of claim 1, wherein the circuit board is a motherboard, further comprising an orphan board received by the motherboard, wherein the orphan board can interface with at least one hardware input selected from the group of hardware inputs consisting of an intrusion detector board, a gas sensor board and a video board.

10. The automatic fire detection and suppression system of claim 1, further comprising:

a pressure gauge in fluid communication with the extinguishant for indicating pressure inside the vessel, the pressure gauge having an indicator pointer so that a reduction in pressure of the extinguishant in the vessel causes a movement of the indicator pointer; and a pair of light emitting and receiving diodes, the diodes facing each other and located such that a movement of the indicator pointer is detected by the diodes, the diodes being coupled to the microprocessor.

11. The automatic fire detection and suppression system of claim 1, further comprising logic in the microprocessor and an output from the circuit board for sending a signal to a remote operator in the event the presence of a fire is detected.

12. The automatic fire detection and suppression system of claim 1, further comprising a satellite ground positioning satellite surveillance device coupled to the microprocessor, wherein the microprocessor has logic and an output for communicating to a remote operator the location of the device when a fire is detected.

* * * * *